US010079449B1

(12) United States Patent
Chien et al.

(10) Patent No.: US 10,079,449 B1
(45) Date of Patent: Sep. 18, 2018

(54) MULTIPLE CONNECTOR SYSTEM

(71) Applicant: Dell Products L.P., Round Rock, TX (US)

(72) Inventors: Tung Yu Chien, New Taipei (TW); Chih-Wei Chen, Taipei (TW)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 15/491,474

(22) Filed: Apr. 19, 2017

(51) Int. Cl.

| | |
|---|---|
| ***H01R 13/62*** | (2006.01) |
| ***H01R 13/627*** | (2006.01) |
| ***H01R 12/71*** | (2011.01) |
| ***H01R 13/631*** | (2006.01) |
| ***H01R 13/633*** | (2006.01) |
| ***H01R 25/00*** | (2006.01) |
| ***H01R 43/26*** | (2006.01) |
| *H01R 33/76* | (2006.01) |

(52) U.S. Cl.
CPC ..... *H01R 13/6275* (2013.01); *H01R 12/716* (2013.01); *H01R 13/6278* (2013.01); *H01R 13/631* (2013.01); *H01R 13/633* (2013.01); *H01R 25/003* (2013.01); *H01R 43/26* (2013.01); *H01R 33/7671* (2013.01)

(58) Field of Classification Search
CPC ..... H01R 13/6278; H01R 13/6275
See application file for complete search history.

(56) References Cited

U.S. PATENT DOCUMENTS

| | | | | |
|---|---|---|---|---|
| 5,529,512 | A * | 6/1996 | Mlyniec | H01R 13/6271 439/352 |
| 6,364,687 | B1 * | 4/2002 | Chen | H01R 13/6275 439/358 |
| 6,860,748 | B2 * | 3/2005 | Ohtani | H01R 13/6275 439/352 |
| 6,948,965 | B2 * | 9/2005 | Kumamoto | H01R 13/6275 439/358 |
| 7,198,522 | B1 * | 4/2007 | Ho | H01R 9/032 439/660 |
| 8,628,345 | B2 * | 1/2014 | Hanson | H01R 13/627 439/352 |
| 2004/0185721 | A1 * | 9/2004 | Moffett | H01R 13/6278 439/660 |
| 2013/0288509 | A1 * | 10/2013 | Jetter | H01R 13/639 439/347 |
| 2015/0171553 | A1 * | 6/2015 | Mauney | H01R 13/6275 439/157 |

* cited by examiner

*Primary Examiner* — James Harvey
(74) *Attorney, Agent, or Firm* — Haynes and Boone, LLP

(57) ABSTRACT

A multiple connector assembly includes a connector housing. A first connector and a second connector, adjacent the first connector, extend from a first surface of the connector housing. A securing member is coupled to the connector housing and is configured to engage a connector coupling member to secure the first connector in a first connector receptacle and the second connector in a second connector receptacle. A connector release actuator that is located on a second surface of the connector housing that is opposite the first surface of the connector housing. The connector release actuator is configured to actuate the securing member to cause the securing member to disengage with the connector coupling member such that the first connector is no longer secured in the first connector receptacle and the second connector is no longer secured in the second connector receptacle.

20 Claims, 11 Drawing Sheets

MULTIPLE CONNECTOR SYSTEM

BACKGROUND

The present disclosure relates generally to information handling systems, and more particularly to a multiple connector system for an information handling system.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems such as, for example, server devices, networking devices, storage devices, and/or other computing devices are often coupled together via cables. Furthermore, these computing devices may also include cables that couple together their various components. For example, interconnect cables such as nano-pitch input/output (NPIO) cables may be provided for serial attached small computer system interface (SCSI) (SAS) connections, serial AT attachment (SATA) connections, and peripheral component interconnect express (PCI) connections, any of which may be used in different applications including storage-to-controller applications, server-to-server applications, server-to-switch applications, switch-to-switch applications, mobile applications, enterprise applications, and/or a variety of other NPIO connection applications known in the art. An NPIO cable includes at least one NPIO connector that can be inserted into a NPIO connector receptacle that is typically attached to a surface of a printed circuit board (PCB) and connected to one or more components on the PCB. Because it often desirable to have PCBs with small form factors and efficient component layouts, space on a PCB for multiple NPIO connector receptacles is often limited, which results in the NPIO connector receptacles often being spaced relatively close together on the PCB. However, the decreased spacing may make it difficult, if not impossible, to insert adjacent NPIO connectors a row and/or column of NPIO connector receptacles, as an NPIO connector housing of an NPIO connector may block another NPIO connector from being inserted into an adjacent receptacle. Furthermore, some applications require two NPIO cables, which can further exacerbate the problems discussed above.

NPIO connector cables that include multiple NPIO connectors on a single NPIO connector housing have been developed. Those multiple NPIO connectors may be inserted into, and released from, multiple NPIO connector receptacles on the PCB at the same time. However, as data transfer needs and the number of components of computing devices increase, the number of NPIO connections provided on the PCBs increase as well, and a common practice is to provide those NPIO connector receptacles arranged in an array. However, when a NPIO connector cable having multiple NPIO connectors is connected to a row of NPIO connector receptacles arranged in an array, and then other NPIO connectors on other NPIO cables are connected to NPIO connector receptacle in an adjacent row of the array, those NPIO connectors often block access to the release mechanism on the NPIO connector housing with multiple NPIO connectors, preventing a user from removing the NPIO connector housing and multiple NPIO connectors from the multiple NPIO connector receptacles. The user is then required to remove NPIO connectors from the PCB before being able to remove the NPIO connector housing with multiple NPIO connectors, which can lead to downtime for functions enabled by those additional NPIO cables, or can result in a user incorrectly reconnecting those NPIO cables to the wrong NPIO connector receptacles.

Accordingly, it would be desirable to provide an improved multiple connector system.

SUMMARY

According to one embodiment, an information handing system (IHS), includes a chassis; a board coupled to the chassis; at least one board component coupled to the board; a first connector receptacle coupled to the at least one board component; a second connector receptacle coupled to the at least one board component, wherein the first connector receptacle and the second connector receptacle include at least one connector coupling member; and a multiple connector assembly, wherein the multiple connector assembly includes a connector housing; a first connector that extends from a first surface of the connector housing; a second connector that extends from the first surface of the connector housing and adjacent the first connector; at least one securing member that is coupled to the connector housing and that is configured to engage the at least one connector coupling member to secure the first connector in the first connector receptacle and the second connector in the second connector receptacle; and a connector release actuator that is located on a second surface of the connector housing that is opposite the first surface of the connector housing, wherein the connector release actuator is configured to actuate the at least one securing member to cause the at least one securing member to disengage with the at least one connector coupling member such that the first connector is no longer secured in the first connector receptacle and the second connector is no longer secured in the second connector receptacle.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
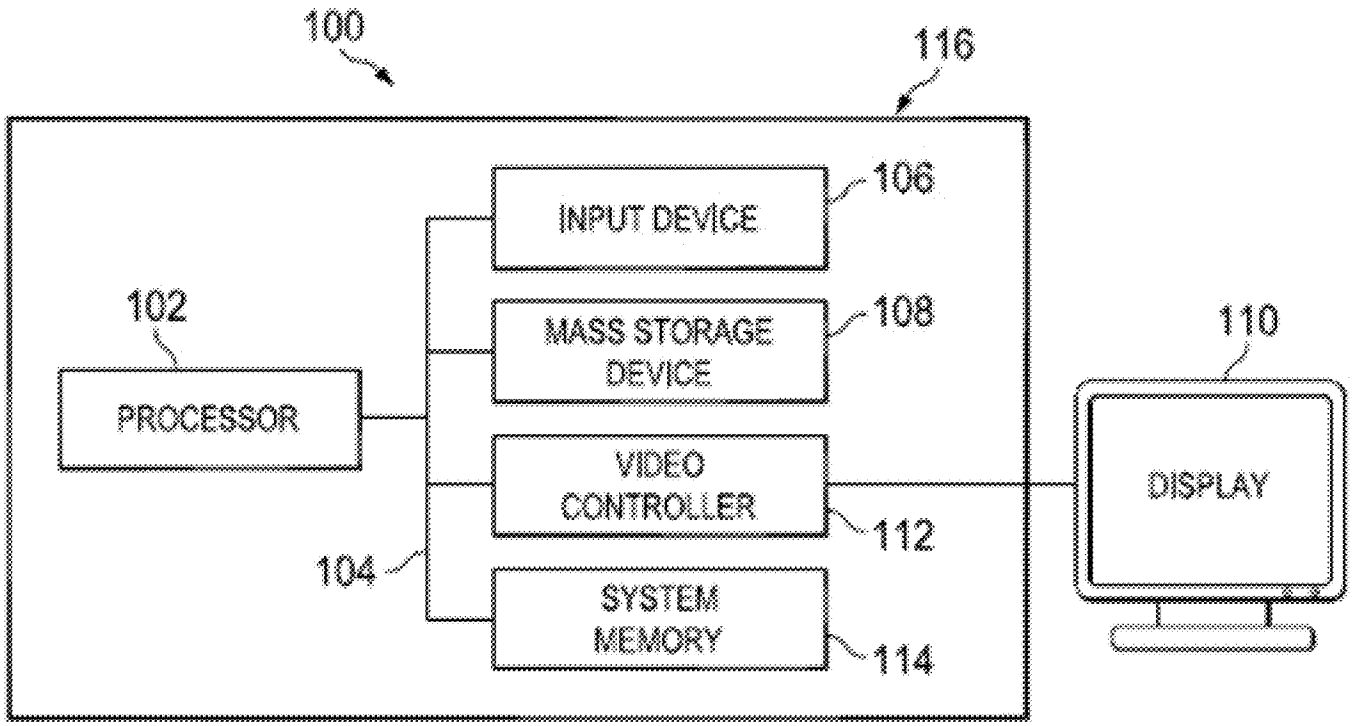
FIG. 1 is a schematic view illustrating an embodiment of an information handling system.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2A:
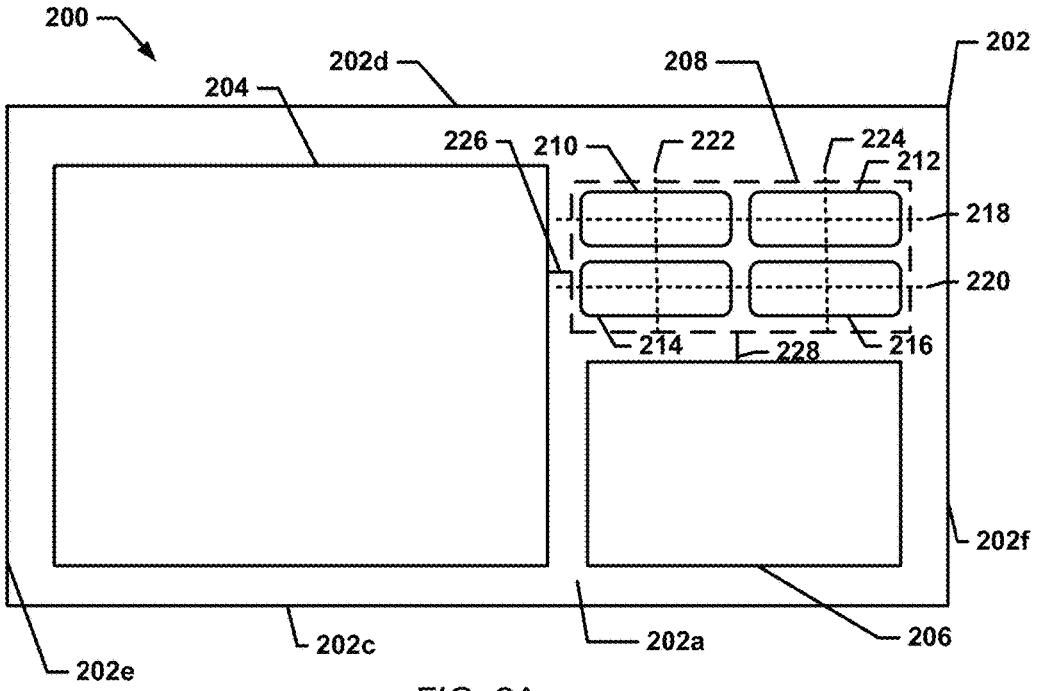
FIG. 2A is a top view illustrating an embodiment of a board.
Figure 2B:
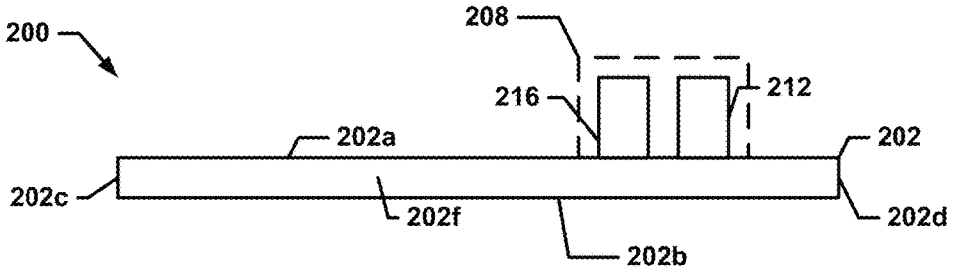
FIG. 2B is a side view illustrating an embodiment of the board of FIG. 2A.
Figure 2C:
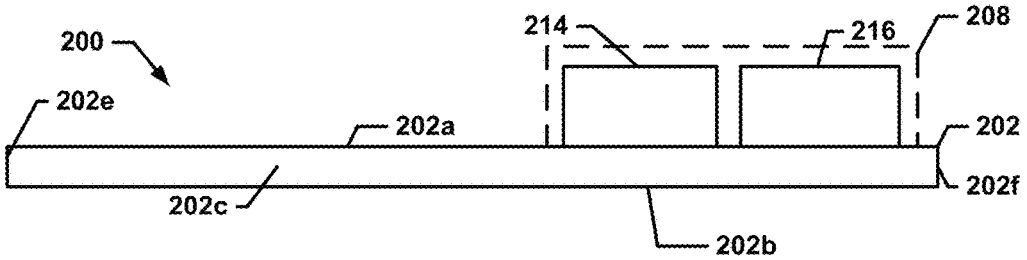
FIG. 2C is a front view illustrating an embodiment of the board of FIG. 2A.

Referring now to FIGS. 2A, 2B, and 2C, an embodiment of a board 200 is illustrated. In an embodiment, the board 200 may be provided in an IHS 100, described above with reference to FIG. 1, such that the board 200 includes and/or is electrically coupled to the processor 102, described above with reference to FIG. 1. In a specific embodiment, the board 202 is provided by a motherboard, although other types of boards are envisioned as falling within the scope of the present disclosure. The board 200 includes a board base 202 having a top surface 202*a*, a bottom surface 202*b* that is located opposite the board base 202 from the top surface 202*a*, a front edge 202*c* extending between the top surface 202*a* and the bottom surface 202*b*, a rear edge 202*d* located opposite the board base 202 from the front edge 202*c* and extending between the top surface 202*a* and the bottom surface 202*b*, and a pair of side edges 202*e* and 202*f* that are located opposite each other on the board base 202 and that each extend between the top surface 202*a*, the bottom surface 202*b*, the front edge 202*c*, and the rear edge 202*d*. One or more board components such as, for example, a first board component 204 and a second board component 206 may be located on the top surface 202*a* of the board base 202. The first board component 204 and the second board component 206 may include a variety of electrical and/or mechanical components that may be provided on the board 200 such as a processor socket for a processor, memory devices, a memory slot for a memory card, a basic input output system (BIOS), various types of controllers, a heat sink, a video card slot, power connectors, a northbridge, a southbridge, and/or other board components that would be apparent to one of skill in the art in possession of the present disclosure.

A connector receptacle array 208 may be included on the top surface 202*a* of the board base 202. The connector receptacle array 208 may include a plurality of connector receptacles such as a first connector receptacle 210, a second connector receptacle 212, a third connector receptacle 214, and a fourth connector receptacle 216. The connector receptacles 210-216 may be coupled to the board components 204 and/or 206 via a first communication bus 226 and/or a second communication bus 228. In a specific embodiment, the connector receptacles 210-216 may be Nano Pitch Input/Output (NPIO) connector receptacles utilized with Serial Attached Small Computer System Interface (SCSI) (SAS), Serial AT Attachment (SATA), Peripheral Component Interconnect Express (PCIe), and/or PCI protocols. However, other connector receptacles (e.g., optical cable connector receptacles, Universal Serial Bus (USB) connector receptacles, Ethernet connector receptacles, a Slimline SATA connector receptacle, and/or other connector receptacles known in the art) may benefit from the teachings of the present disclosure and thus are envisioned as falling within its scope. While four connector receptacles 210-216 are illustrated in the connector receptacle array 208, the connector receptacle array 208 may include only two connector receptacles (e.g., connector receptacles 210 and 212), or may include more than four connector receptacles, and still benefit from the teachings of the present disclosure. Furthermore, while connector receptacle array 208 includes a plurality of connector receptacles (i.e., female connectors), one of skill in the art in possession of the present disclosure will recognize that the connector receptacle array 208 may be replaced by a connector array that includes a plurality of connectors (i.e., male connectors), or an array that includes both connector receptacles and connectors, while still falling within the scope of the present disclosure.

As illustrated, the first connector receptacle 210 and the second connector receptacle 212 may be included in a first row of the connector receptacle array 208. As such, the first connector receptacle 210 and the second connector receptacle 212 may be considered to be in an "in-line connector receptacle orientation" that includes a first common longitudinal connector axis 218. However, it is contemplated that the first connector receptacle 210 and the second connector receptacle 212 may be staggered or otherwise offset such that they do not share the common longitudinal connector axis 218 illustrated in FIG. 2A. Similarly, the third connector receptacle 214 and the fourth connector receptacle 216 may be included in a second row of the connector receptacle array 208. As such, the third connector receptacle 214 and the fourth connector receptacle 216 may be considered to be in an in-line connector receptacle orientation that includes a second common longitudinal connector axis 220. However, it is contemplated that the third connector receptacle 214 and the fourth connector receptacle 216 may be staggered or otherwise offset such that they do not share the common longitudinal connector axis 218 illustrated in FIG. 2A. Also, it is contemplated that the second row may only include the third connector receptacle 214 (i.e., the fourth connector receptacle 216 may be omitted.)

In an embodiment, the first connector receptacle 210 and the third connector receptacle 214 may be included in a first column of the connector receptacle array 208. As such, the first connector receptacle 210 and the third connector receptacle 214 may be considered to be in an in-line connector receptacle orientation that includes a first common latitudinal connector axis 222. However, it is contemplated that the first connector receptacle 210 and the third connector receptacle 214 may be staggered or otherwise offset such that they do not share the common latitudinal connector axis 222 illustrated in FIG. 2A. Similarly, the second connector receptacle 212 and the fourth connector receptacle 216 may be included in a second column of the connector receptacle array 208. As such, the second connector receptacle 212 and the fourth connector receptacle 216 may be considered to be in an in-line connector receptacle orientation that includes a second common latitudinal connector axis 224. However, it is contemplated that the second connector receptacle 212 and the fourth connector receptacle 216 may be staggered or otherwise offset such that they do not share the common latitudinal connector axis 224. Also, it is contemplated that the second row may only include the third connector receptacle 214 (i.e., the fourth connector receptacle 216 may be omitted.) Thus, in some embodiments, the third connector receptacle 214 may be included in the first column with the first connector receptacle 210, the second column with the second connector receptacle 212, or between first column and the second column.

Figure 3:
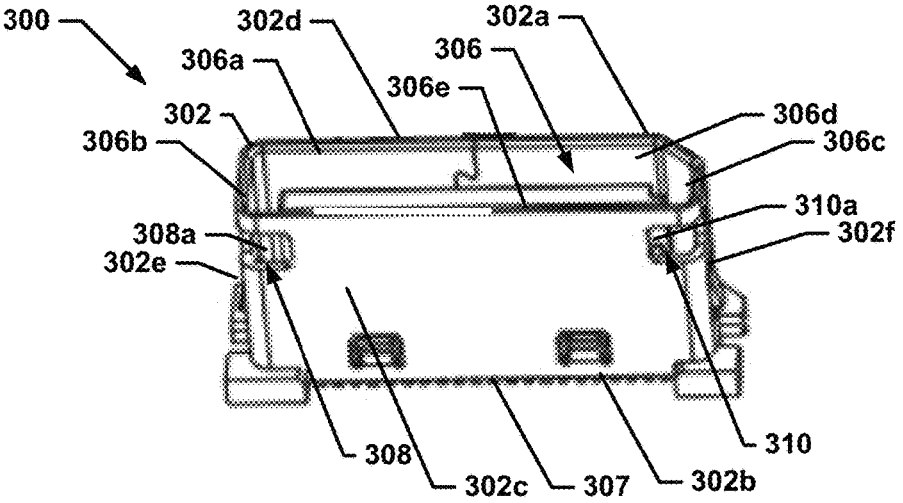
FIG. 3 is a perspective view illustrating an embodiment of a connector receptacle.

Referring to FIG. 3, an embodiment of a connector receptacle 300 is illustrated that may be any of the connector receptacles 210-216 of FIG. 2. As such, the connector receptacle 300 may be an NPIO connector receptacle. The connector receptacle 300 includes a connector receptacle body 302 having a top surface 302*a*, a bottom surface 302*b* located opposite the connector receptacle body 302 from the top surface 302*a*, a front edge 302*c* extending between the top surface 302*a* and the bottom surface 302*b*, a rear edge 302*d* located opposite the connector receptacle body 302 from the front edge 302*c* and extending between the top surface 302*a* and bottom surface 302*b*, and a pair of opposing side edges 302*e* and 302*f* located opposite the connector receptacle body 302 from each other and extending between the top surface 302*a*, the bottom surface 302*b*, the front edge 302*c*, and the rear edge 302*d*. A connector receptacle channel 306 is defined by the connector receptacle body 302 and extends into the connector receptacle body 302 from a channel entrance 306*a* located on the top surface 302*a*. The connector receptacle channel 306 is defined by a first channel side edge surface 306*b*, a second channel side edge surface 306*c* located opposite the connector receptacle channel 306 from the first channel side edge surface 306*b*, and a channel rear surface 306*d* and a channel front surface 306*e* that are located opposite the connector receptacle channel 306 from each other and that both extend between the channel entrance surface 306*a* and a channel bottom surface 306*f*.

The connector receptacle 300 may include a plurality of connector receptacle contact members 307 that are located on the connector receptacle body 302 adjacent the connector receptacle channel 306, and that extend through the bottom surface 302*b* of the connector receptacle body 302. As discussed below, the connector receptacle contact members 307 may be coupled to one or more of the communication buses 226 and 228 on the board 200. A first connector coupling member 308 is located on the side edge 302*e* of the connector receptacle body 302 adjacent the front edge 302*c* and defines a first aperture 308*a* extending through the connector receptacle body 302. While the first aperture 308*a* is illustrated as hole that extends through the connector receptacle body 302, in some embodiments the first connector coupling member 308 may define a channel that does not extend all of the way through the connector receptacle body 302. A second connector coupling member 310 is located on the side edge 302*f* of the connector receptacle body 302 adjacent the front edge 302*c* of the connector receptacle body 302, opposite the connector receptacle body 302 from the first connector coupling member 308, and defines a second aperture 310*a* extending through the connector receptacle body 302. While the second aperture 310*a* is illustrated as a hole that extends through the connector receptacle body 302, in some embodiments the second connector coupling member 310 may define a channel that does not extend all of the way through the connector receptacle body 302. While only two connector coupling members are illustrated, in different embodiments a single connector coupling member or additional connector coupling members may be provided and/or located in different positions other than what is illustrated.

Figure 4:
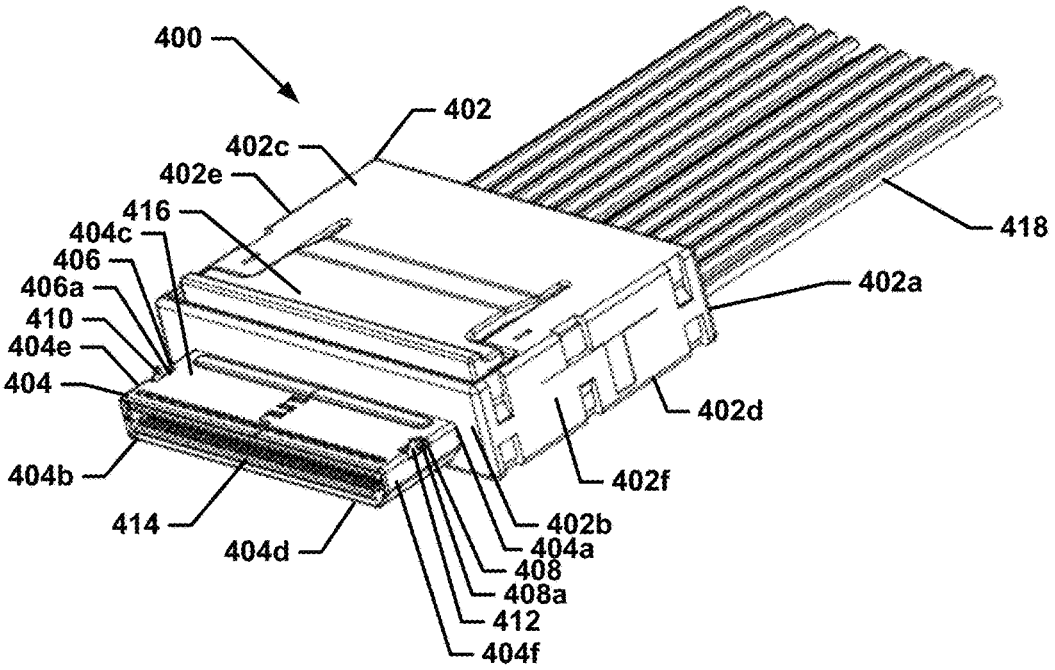
FIG. 4 is a perspective view illustrating an embodiment of a cable system.

Referring now to FIG. 4, an embodiment of a cable system 400 is illustrated. In a specific embodiment, the cable system 400 may be an NPIO cable system including a connector 404 that may be Nano Pitch Input/Output (NPIO) connector utilized with Serial Attached Small Computer System Interface (SCSI) (SAS), Serial AT Attachment (SATA), Peripheral Component Interconnect Express (PCIe), and/or PCI protocols. However, other connectors (e.g., optical cable connectors, Universal Serial Bus (USB) connectors, Ethernet connectors, a Slimline SATA connector, and/or other connectors known in the art) may benefit from the teachings of the present disclosure and thus are envisioned as falling within its scope. The cable system 400 includes a connector body 402 having a top surface 402*a*, a bottom surface 402*b* located opposite the connector body 402 from the top surface 402*a*, a front edge 402*c* extending from the top surface 402*a* and the bottom surface 402*b*, a rear edge 402*d* located opposite the connector body 402 from the front edge 402*c* and extending between the top surface 402*a* and bottom surface 402*b*, and a pair of opposing side edges 402*e* and 402*f* extending between the top surface 402*a*, the bottom surface 402*b*, the front edge 402*c*, and the rear edge 402*d*.

The cable system 400 includes the connector 404 that may extend from the bottom surface 402*b* of the connector body 402. The connector 404 may have a top surface 404*a*, a bottom surface 404*b* located opposite the connector 404 from the top surface 404*a*, a front edge 404*c* extending from the top surface 404*a* and the bottom surface 404*b*, a rear edge 404*d* located opposite the connector 404 from the front edge 404*c* and extending between the top surface 404*a* and the bottom surface 404*b*, and a pair of opposing side edges 404*e* and 404*f* extending between the top surface 404*a*, the bottom surface 404*b*, the front edge 404*c*, and the rear edge 404*d*.

A first connector receptacle coupling member 406 is located on the side edge 404*e* of the connector 404 adjacent the front edge 404*c*, and may define a first aperture 406*a* that extends through the connector 404. A first securing member 410 may extend through the first aperture 406*a*, and may be configured to engage the first connector coupling member 308 of the connector receptacle 300 of FIG. 3 when the connector 404 is inserted into the connector receptacle channel 306. A second connector receptacle coupling member 408 is located on the side edge 404*f* of the connector 404 adjacent the front edge 404*c*, is located on an opposite side of the connector 404 from the first connector receptacle coupling member 406, and may define a second aperture 408*a* that extends through the connector 404. A second securing member 412 may extend through the second aperture 408*a*, and may be configured to engage the second connector coupling member 310 of the connector receptacle 300 of FIG. 3 when the connector 404 is inserted into the connector receptacle channel 306. Although two connector coupling receptacle members are illustrated, in some embodiments, only one connector receptacle coupling member, or additional connector receptacle coupling members, may be provided, and/or connector receptacle coupling members may be located in different positions other than what is illustrated while remaining within the scope of the present disclosure.

In an embodiment, the connector body 402 may include a connector release system 416 on the front edge 402*c* that, when activated, may cause the first securing member 410 and/or the second securing member 412 to move to allow the connector 404 to be released from the connector receptacle 300 by causing the first securing member 410 and/or the second securing member 412 to disengage with the first connector coupling member 308 and the second connector coupling member 310, respectively.

In various embodiments, the connector 404 may include a plurality of connector contact members 414 that may be located on the bottom surface 404*b* in the connector 404 or in a channel defined by the connector 404 adjacent the bottom surface 404*b*. As discussed below, each of the connector contact members 414 may each engage a respective connector receptacle contact member 307 in the connector receptacle 300 when the connector 404 is inserted into the connector receptacle channel 306, allowing electrical communications between the cable system 400 and the connector receptacle 300. The connector contact members 414 may also be coupled to a cable 418 that extends from the top surface 402*a* of the connector body 402. For example, the cable 418 may be a flat flexible cable, as illustrated, or a variety of other types of cables that would be apparent to one of skill in the art in possession of the present disclosure.

Figure 5:
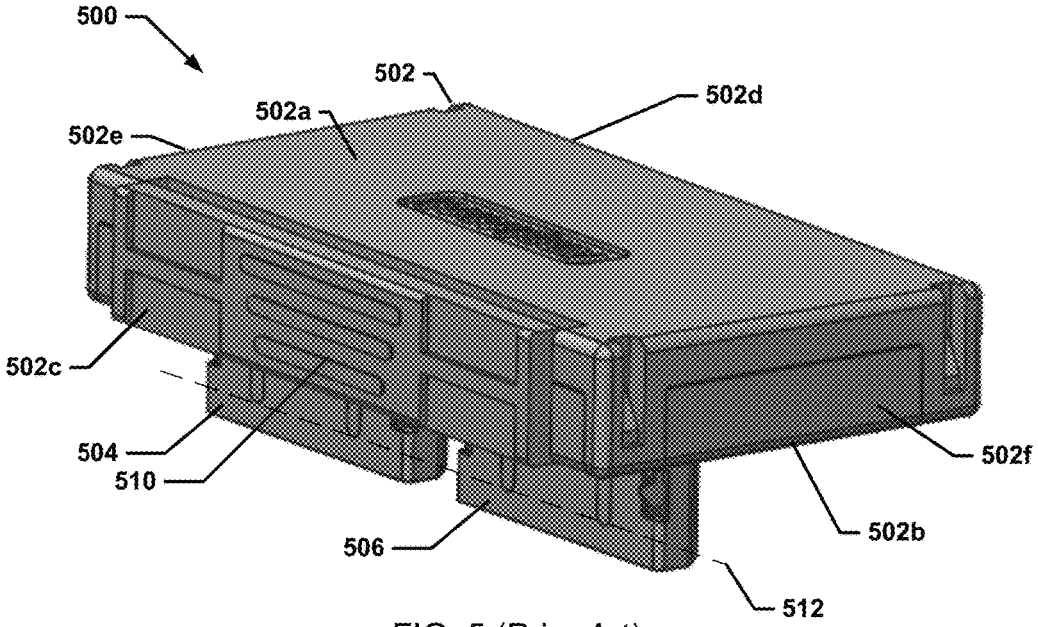
FIG. 5 (Prior Art)
FIG. 5 is a perspective view illustrating a prior art dual-in-one plug.

Referring to FIG. 5, a prior art dual-in-one plug 500 is illustrated. In a specific embodiment, the dual-in-one plug 500 may be an NPIO dual-in-one plug. The dual-in-one plug 500 may include a connector housing 502 having a top surface 502*a*, a bottom surface 502*b* located opposite the connector housing 502 from the top surface 502*a*, a front edge 502*c* extending from the top surface 502*a* and the bottom surface 502*b*, a rear edge 502*d* located opposite the connector housing 502 from the front edge 502*c* and extending between the top surface 502*a* and the bottom surface 502*b*, and a pair of opposing side edges 502*e* and 502*f* extending between the top surface 502*a*, the bottom surface 502*b*, the front edge 502*c*, and the rear edge 502*d*.

The dual-in-one plug 500 may include a first connector 504 and a second connector 506 that each extend from the bottom surface 502*b* of the connector housing 502. The first connector 504 and/or the second connector 506 may each be provided by, for example, the connector 404 on the cable system 400 illustrated in FIG. 4. As can be seen in the illustrated embodiment, the first connector 504 and the second connector 506 are located adjacent to each other in an in-line connector orientation that includes a common longitudinal connector axis 512. Furthermore, the dual-in-one plug 500 includes a connector release system 510 on the front edge 502*c* that, when activated, causes securing members of the first connector 504 and the second connector 506 to move such that, when the first connector 504 and the second connector 506 are connected to respective connector receptacles 300 of FIG. 3, the securing members disengage the connector coupling members on their respective connector receptacles. The first connector 504 and the second connector 506 may be coupled to at least one cable (not illustrated) that may extend from the rear edge 502*d* of the connector housing 502. While a dual-in-one plug 500 is illustrated, one skilled in the art will recognize that other plug/connector assemblies with front edge connector release mechanisms (e.g., single connector assemblies) may benefit from the teachings of the present disclosure.

Figure 6A:
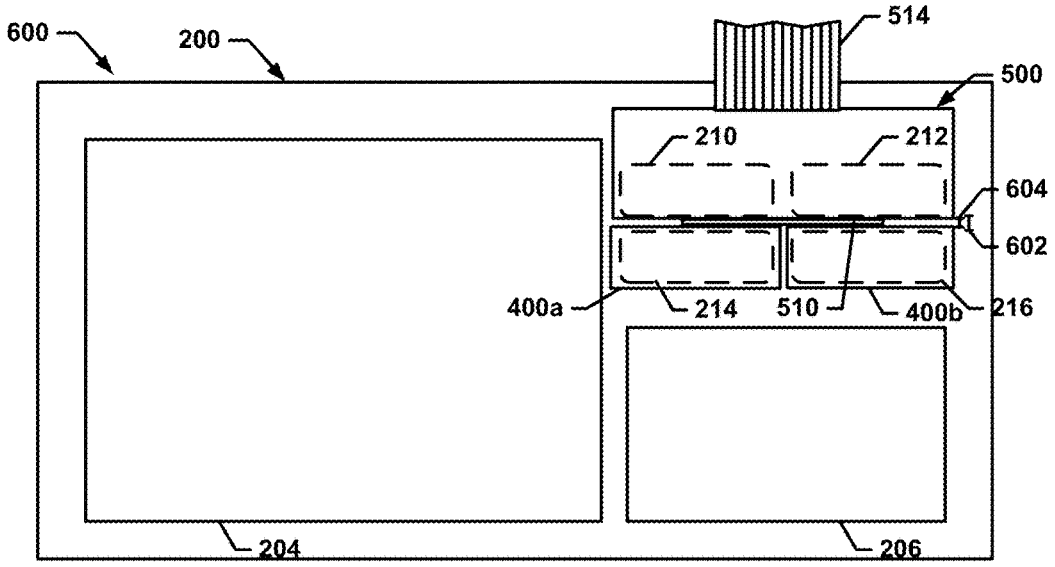
FIG. 6A is a top view illustrating the board of FIGS. 2A-2C including the prior art dual-in-one plug of FIG. 5.
Figure 6B:
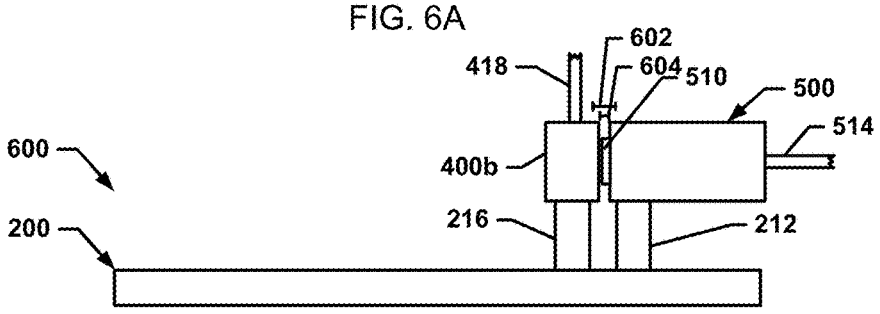
FIG. 6B is a side view illustrating the board of FIG. 6A.
Figure 6C:
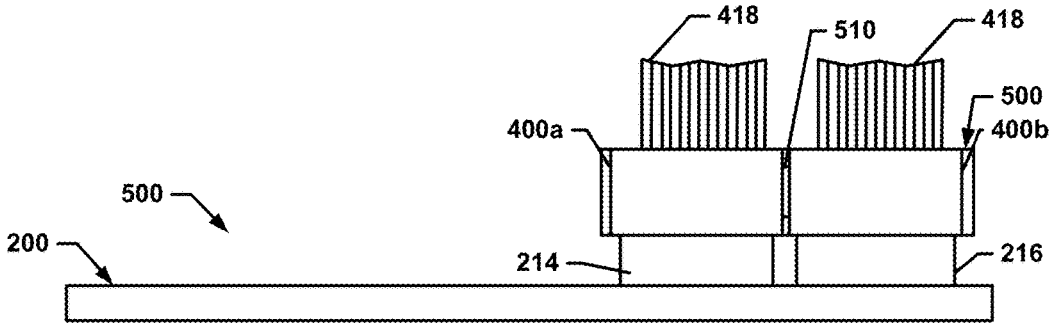
FIG. 6C is a front view illustrating the board of FIG. 6A.

Referring now to FIGS. 6A, 6B, and 6C, an embodiment of a board system 600 is illustrated to provide a discussion of problems with the prior art dual-in-one plug 500. The board system 600 is substantially identical to the board 200 of FIG. 2. As illustrated, a cable system 400 is coupled to each of the third connector receptacle 214 and the fourth connector receptacle 216 in the second row of the connector receptacle array 208, and the first connector 504 and the second connector 506 on the dual-in-one plug 500 are coupled to the first connector receptacle 210 and the second connector receptacle 212, respectively, of the first row of the connector receptacle array 208. FIGS. 6A and 6B illustrate how the connector housing 502 of dual-in-one plug 500 includes a cable 514 that, for example, allows communication with the board components 204 and/or 206 via the dual-in-one plug 500 (e.g., via a device connected to the cable 514.) As illustrated, a first spacing 602 separates the first row and the second row of the connector receptacle array 208. As discussed above, in conventional systems the first spacing 602 is often only wide enough to allow cable systems 400*a*/400*b* and the dual-in-one plug 500 to be coupled to the board 200, while minimizing the size of the board 200 and/or providing more space for other components on the board 200. With the cable systems 400*a* and 400*b* and the dual-in-one plug 500 coupled to the connector receptacles 210, 212, 214, and 216, a second spacing 604 between the rear edges 402*d* of the connector bodies 402 of the cable systems 400*a* and 400*b* and the front edge 502*c* of the connector housing 502 is provided. That second spacing 604 includes a width that is less than the width of a human finger such that if a user that wants to detach the dual-in-one plug 500 from the connector receptacles 210 and 212, the user must first remove the first cable system 400*a* and the second cable system 400*b* to access and activate the connector release system 510. For example, in different embodiments, the second spacing has been measured to be less than 3 cm, less than 2 cm, less than 1 cm, less than 0.8 cm, less than 0.5 cm, and in some cases less than 0.2 cm. As discussed above, having to remove the first cable system 400*a* and/or the second cable system 400*b* may result in incorrect reconnection of those cables, system downtime, and/or other issues associated with the removal and reattachment of cable systems. While a dual-in-one plug is illustrated, one skilled in the art will recognize that other plug/connector assemblies with front edge connector release mechanisms (e.g., single connector assemblies such as a Slim Line SATA connector having a front edge connector release mechanism) may benefit from the teachings of the present disclosure.

Figure 7A:
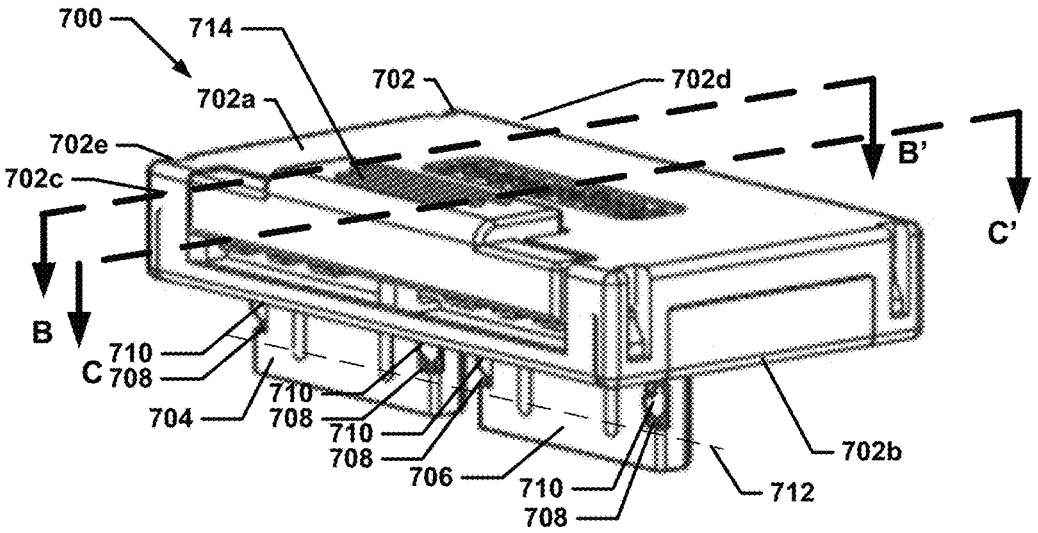
FIG. 7A is a perspective view illustrating an embodiment of a multiple connector assembly.
Figure 7B:
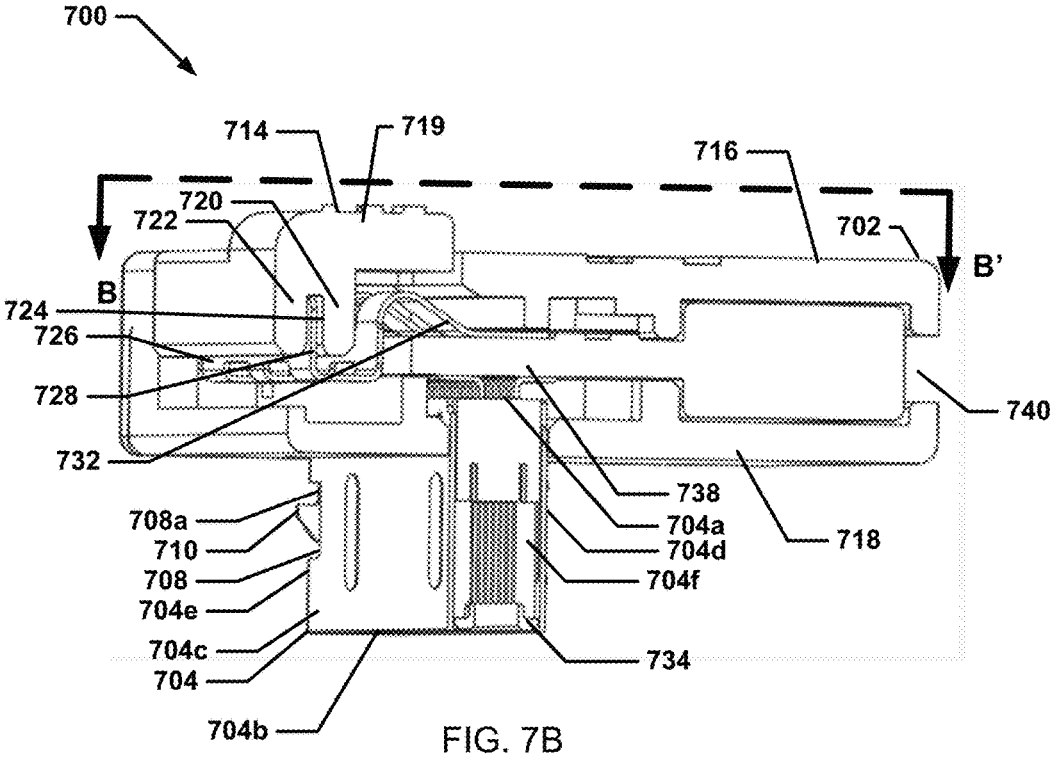
FIG. 7B is a perspective cross-sectional view along section B-B' of the multiple connector assembly of FIG. 7A.
Figure 7C:
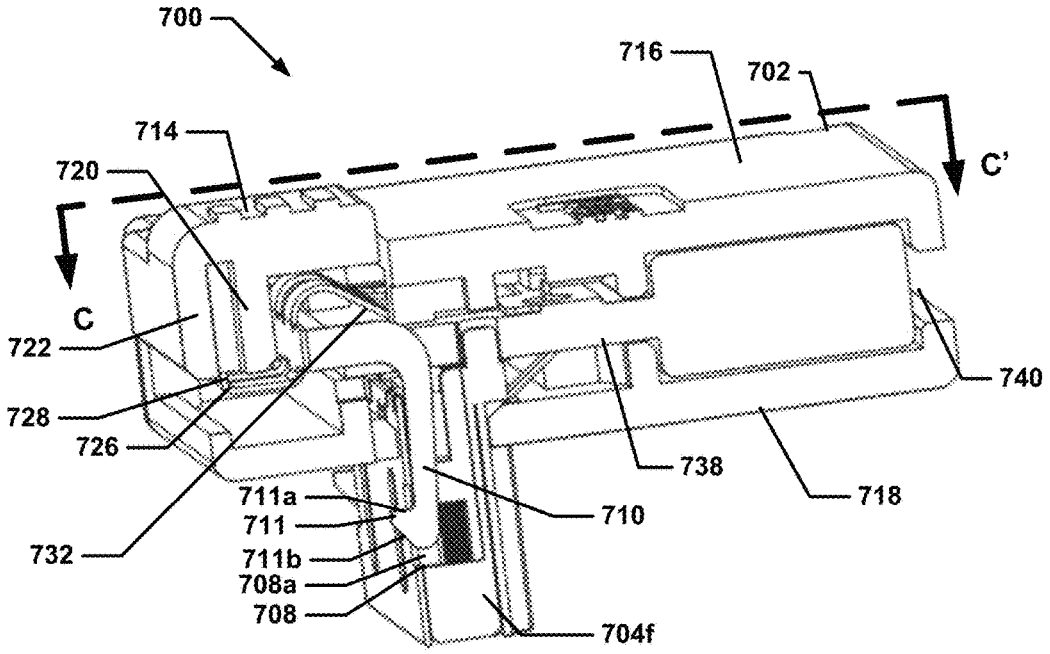
FIG. 7C is a perspective cross-sectional view along section C-C' of the multiple connector assembly of FIG. 7A.

Referring now to FIGS. 7A, 7B, and 7C, an embodiment of a multiple connector assembly 700 is illustrated. In a specific embodiment, the multiple connector assembly 700 may be a multiple NPIO connector assembly. However, other connector assemblies are envisioned as benefiting from the present disclosure. The multiple connector assembly 700 includes a connector housing 702 having a top surface 702*a*, a bottom surface 702*b* located opposite the connector housing 702 from the top surface 702*a*, a front edge 702*c* extending from the top surface 702*a* and the bottom surface 702*b*, a rear edge 702*d* located opposite the connector housing 702 the front edge 702*c* and extending between the top surface 702*a* and bottom surface 702*b*, and a pair of opposing side edges 702*e* and 702*f* extending between the top surface 702*a*, the bottom surface 702*b*, the front edge 702*c*, and the rear edge 702*d*. The connector housing 702 may include a top housing cover 716 and a bottom housing cover 718 that, when coupled together, form a cable channel 740 on the rear edge 702*d* of the connector housing 702.

The connector assembly 700 includes a plurality of connectors (e.g., a first connector 704 and a second connector 706) that may extend from the bottom surface 702*b* of the connector housing 702. The first connector 704 and the second connector 706 may be in-line with each other such that the first connector 704 and the second connector 706 share a common connector axis 712. While the following describes the first connector 704, the second connector 706 may be identical to the first connector 704 and thus may include the features discussed below. In an embodiment, the first connector may include some or all of the components of the connector 404 of the cable system 400 of FIG. 4. As such, the first connector 704 may have a top surface 704*a*, a bottom surface 704*b* located opposite the first connector 704 from the top surface 704*a*, a front edge 704*c* extending from the top surface 704*a* and the bottom surface 704*b*, a rear edge 704*d* located opposite the first connector 704 from the front edge 704*c* and extending between the top surface 704*a* and bottom surface 704*b*, and a pair of opposing side edges 704*e* and 704*f* extending between the top surface 704*a*, the bottom surface 704*b*, the front edge 704*c*, and the rear edge 704*d*.

The multiple connector assembly 700 includes at least one connector receptacle coupling member 708. As illustrated, a connector receptacle coupling member 708 may be located on the side edge 704*e* and/or the side edge 704*f* of the first connector 704, adjacent the front edge 704*c*, and may define a first aperture 708*a* that extends through the first connector 704. A first securing member 710 may extend through the first aperture 708*a*, and may be configured to engage the first connector coupling member 308 on the connector receptacle 300 of FIG. 3 when the first connector 704 is inserted into the connector receptacle channel 306. The first securing member 710 may include a first coupling portion 711 that is located on a distal end of the first securing member 710. The first coupling portion 711 includes a first securing surface 711*a* and a first beveled edge 711*b* located adjacent the first securing surface 711*a*. In an embodiment, the first connector receptacle coupling member 708 may be the only connector receptacle securing member located on the multiple connector assembly 700. In an embodiment, each of the first connector 704 and the second connector 706 may have at least one connector receptacle coupling member. In an embodiment, the first connector receptacle securing member 708 may be located in different positions other than what is illustrated, such as, for example, between two connectors 704 and 706.

In various embodiments, the connector housing 702 may include a connector release actuator 714 that is located on the top surface 702*a* and that is coupled with the first securing member 710. The connector release actuator 714 may be configured to be actuated to cause the first securing member 710, or any other securing members of the multiple connector assembly 700, to move such that, when the first connector 704 is connected with the connector receptacle 300 of FIG. 3, the first securing member 710 disengages with the first connector coupling member 308. The connector release actuator 714 may be configured to be actuated when the connector release actuator 714 is either pushed and/or pressed. For example, the connector release actuator 714 may include a coupling channel 724 that is defined by a first planar member 720 and a second planar member 722 that are spaced apart from each other and that extend from a top portion 719 of the connector release actuator 714. The coupling channel 724 may be configured to receive a coupling member 728 of a biasing member 726. The coupling member 728 may also be coupled to a proximal end of the first securing member 710. The biasing member 726 may also include a spring 732 that is coupled to the coupling member 728 at a first end of the spring 732, with a second end of a spring 732 coupled to the connector housing 702 and/or a connector board 738.

In various embodiments, the first connector 704 may include a plurality of connector contact members 734 located on the bottom surface 704*b* in the first connector 704 or in a channel that is defined by the first connector 704 adjacent the bottom surface 704*b*. The connector contact members 734 may each engage a respective connector receptacle contact member 307 of the connector receptacle 300 when the first connector 704 is inserted into the connector receptacle channel 306, allowing electrical communications to be transmitted between the multiple connector assembly 700 and the connector receptacle 300. Each connector contact member 734 may also be coupled to the connector board 738 housed in the connector housing 702, which may be oriented substantially perpendicularly to the first connector 704 and the second connector 706. The connector board 738 may be configured to couple to a cable (not illustrated) that can be received through the cable channel 740. While the multiple connector assembly 700 includes at least two connectors 704 and 706, one of skill in the art in possession of the present disclosure will recognize that a connector assembly with a single connector may benefit from the teachings of the present disclosure such that a single connector assembly includes the connector release system described above.

Figure 8:
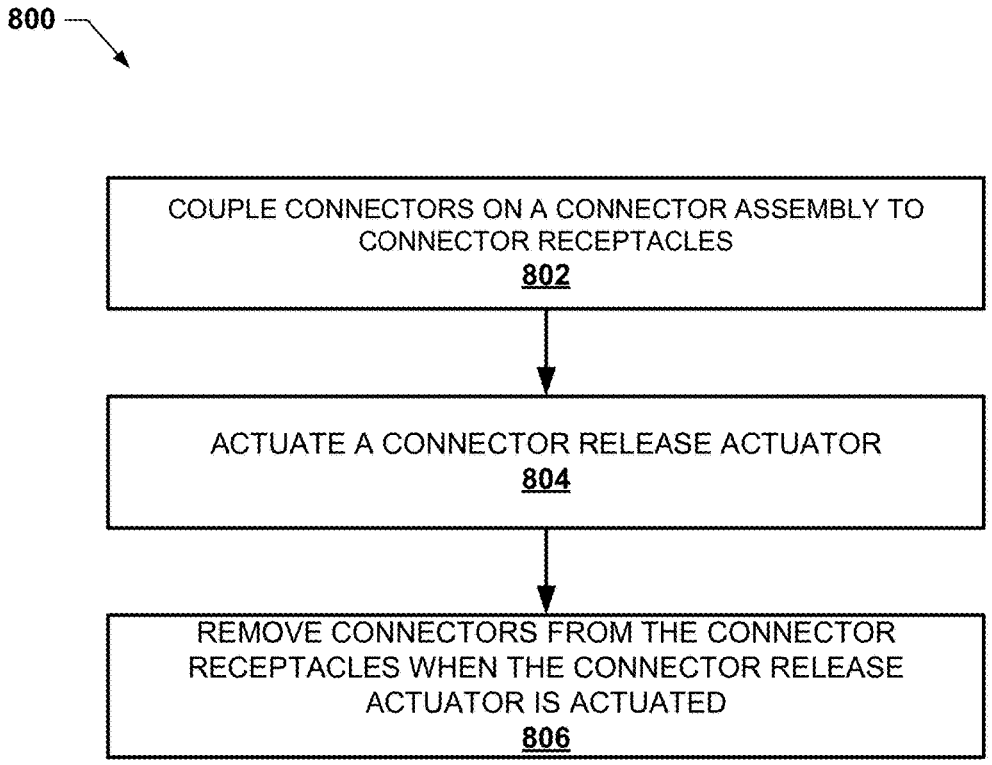
FIG. 8 is a flow chart illustrating an embodiment of a method for coupling a multiple connector assembly to a board.

Referring now to FIG. 8, an embodiment of a method 800 for securing and releasing a multiple connector assembly is illustrated. As discussed below, the systems and method of the present disclosure provide for securing a multiple connector assembly to a plurality of connector receptacles that may be coupled to a board. The multiple connector assembly includes a connector release actuator that is located on the top of the multiple connector assembly and that, when actuated, causes at least one securing member of the multiple connector assembly to move to release a connector on the multiple connector assembly from a connector receptacle on the board. The connector release actuator located on the top of the multiple connector assembly provides benefits over conventional multiple connector plugs that provided a release mechanism on a front face of the plug. For example, when conventional dual-in-one NPIO connector plugs are used in multi-row NPIO connector receptacle arrays, access to the front facing release mechanism is often blocked by single NPIO connectors inserted into NPIO connector receptacles that are adjacent the NPIO connector receptacles to which a dual-in-one NPIO connector plug is connected. As such, the multiple connector assembly of the present disclosure may be disconnected from a connector receptacle array using the connector release actuator and without the need to remove other connectors that are coupled to adjacent connector receptacles.

Figure 9A:
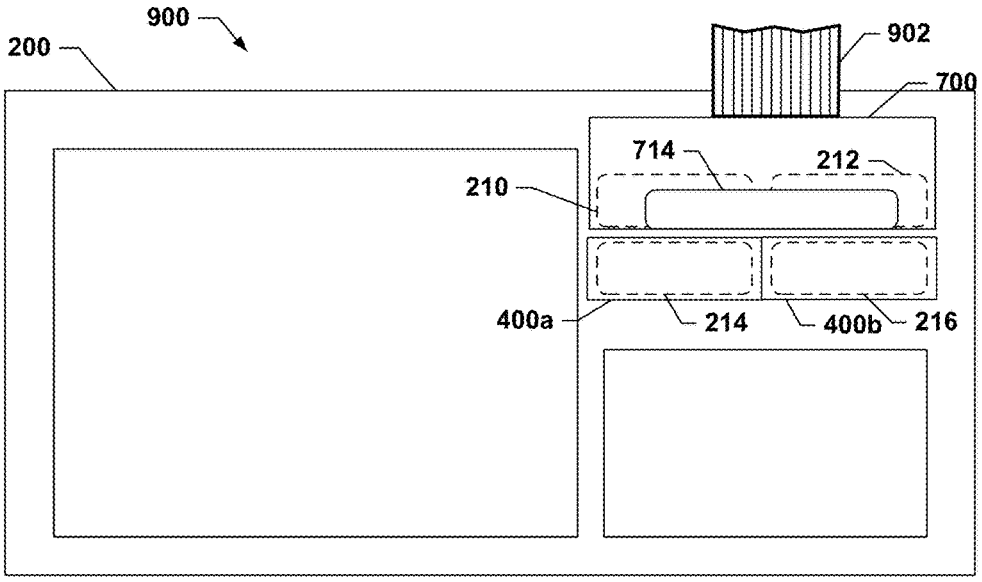
FIG. 9A is a top view illustrating an embodiment of a multiple connector system that includes the board of FIGS. 2A-2C coupled with the multiple connector assembly of FIGS. 7A-7C and a cable system of FIG. 4.
Figure 9B:
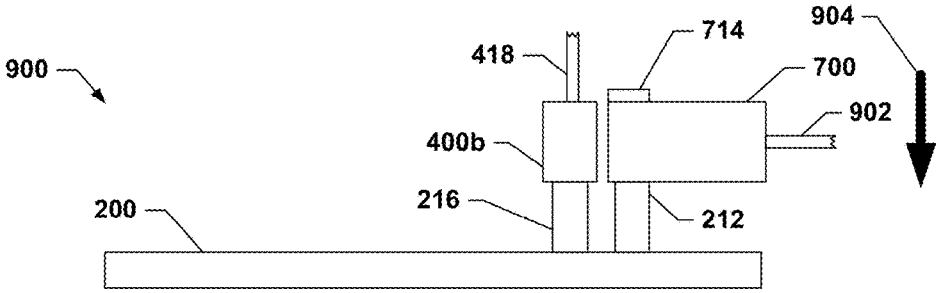
FIG. 9B is a side view illustrating an embodiment of the multiple connector system of FIG. 9A.
Figure 9C:
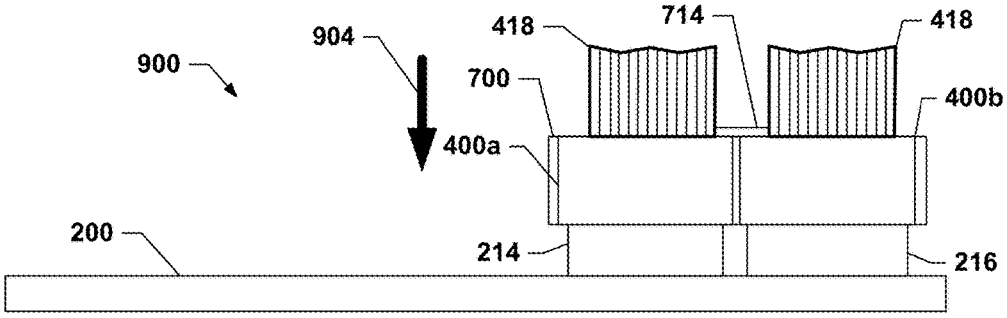
FIG. 9C is a front view illustrating an embodiment of the multiple connector system of FIG. 9A.

The method 800 begins at block 802 where the connectors of a multiple connector assembly are coupled to connector receptacles in a connector receptacle array. Referring to FIGS. 9A, 9B, and 9C, an embodiment of a multiple connector system 900 is illustrated. The multiple connector system 900 includes the board 200 of FIGS. 2A-2C. At least one cable system 400 (e.g., a first cable system 400*a*, and/or a second cable system 400*b*) of FIG. 4 is coupled to the third connector receptacle 214 and/or fourth connector receptacle 216 in the second row of the connector receptacle array 208 on the board 200. The first connector 704 and the second connector 706 on the multiple connector assembly 700 of FIGS. 7A-7C may be inserted into the first connector receptacle 210 and the second connector receptacle 212, respectively, in the first row of the connector receptacle array 208, as indicated by the arrow 904. FIGS. 9A and 9B illustrate a cable 902 on the multiple connector assembly 700 that may complete a connection between at least one of the board components 204 and/or 206 and another device. FIGS. 9A and 9B also illustrated how the multiple connector assembly 700 includes the connector release actuator 714 located on the top surface 702*a* of the multiple connector assembly 700.

In an embodiment, the at least one securing member 710 on the multiple connector assembly 700 is coupled to the biasing member 726 that biases the at least one securing member 710 into a securing orientation. For example, when the first connector 704 and the second connector 706 are inserted into the first connector receptacle 210 and the second connector receptacle 212, the at least one securing member 710 that is coupled to the connector release actuator 714 is biased into engagement with the at least one connector coupling member 308 to secure the first connector 704 in a first connector receptacle 210 and the second connector 706 in a second connector receptacle 212. In a particular example, the channel front surface 306*e* of the connector receptacle channel 306 on the connector receptacle 300 of FIG. 3 may engage the first beveled edge 711*b* of the first securing member 710. Engagement of the channel front surface 306*e* with the first beveled edge 711*b* on the first securing member 710 deflects the first securing member 710 in a first direction such that the first connector 704 and the second connector 706 may continue to move in a second direction indicated by the arrow 904 until the first securing member 710 is biased by the biasing member 726 in a third direction and into the first aperture 308*a* such that the first securing surface 711*a* engages the first aperture 308*a* in the securing orientation. When the first securing surface 711*a* engages the first aperture 308*a*, the plurality of connector contact members 734 of the first connector 704 and the second connector 706 are secured in engagement with the plurality of connector receptacle contact members 307 of the connector receptacles 210 and 212.

Figure 10A:
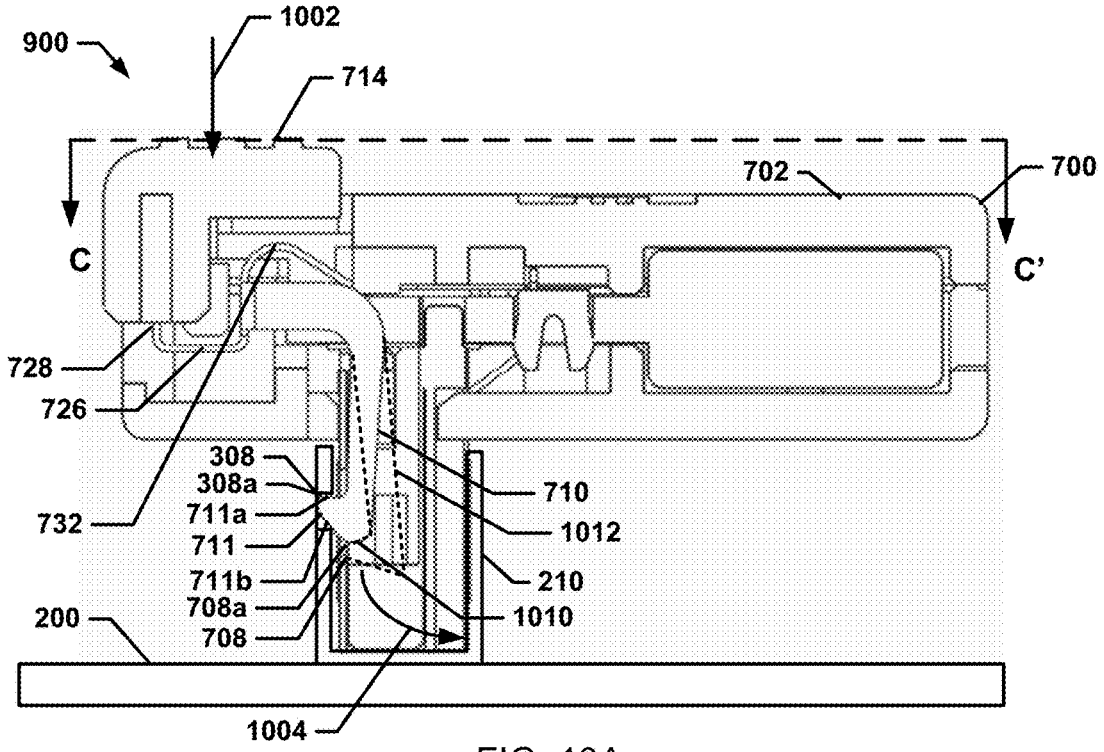
FIG. 10A is a cross-sectional view of an embodiment of the multiple connector system of FIGS. 9A-9C, along section C-C' of the multiple connector assembly of FIG. 7A, illustrating an embodiment of the actuation of the connector release actuator.
Figure 10B:
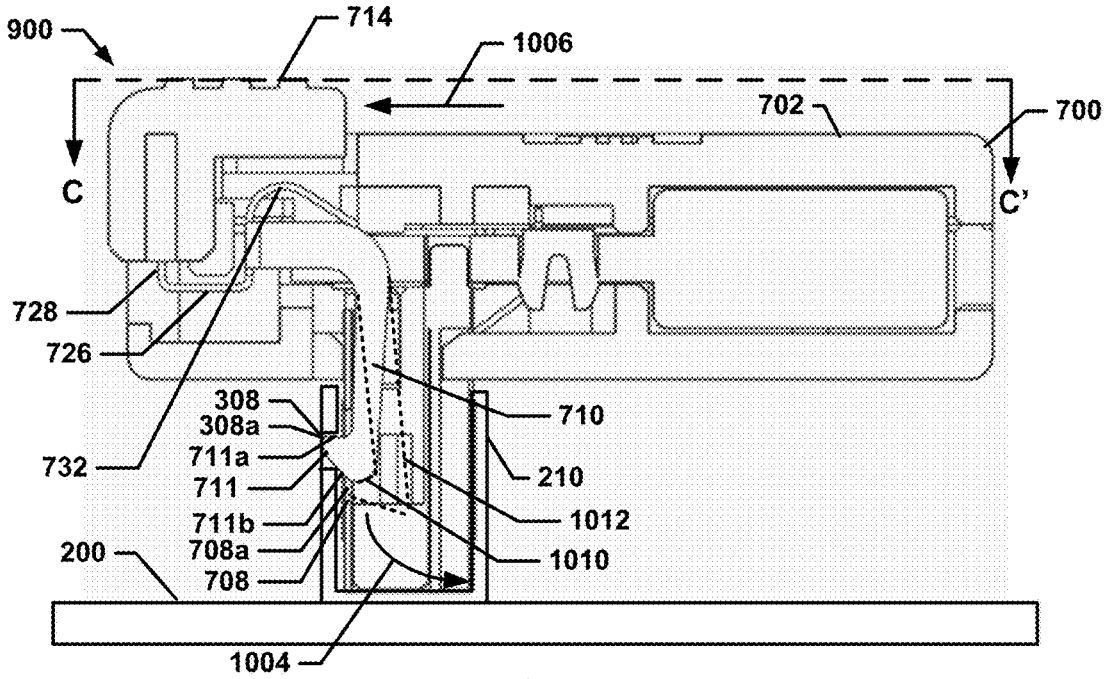
FIG. 10B is a cross-sectional view of an embodiment of the multiple connector system of FIGS. 9A-9C, along section C-C' of the multiple connector assembly of FIG. 7A, illustrating an embodiment of the actuation of the connector release actuator.

The method 800 then proceeds to block 804 where a connector release actuator of the multiple connector assembly is actuated. Referring to FIGS. 10A and 10B, a cross-sectional view along the section C-C' of FIG. 7A of the multiple connector assembly 700 is illustrated. As illustrated in FIGS. 10A-10B, the first connector 704 has been inserted into the first connector receptacle 210 and the first securing member 710 engages at least one connector coupling member 308 to secure the first connector 704 in the first connector receptacle 210. As illustrated, the first securing surface 711*a* engages the first aperture 308*a* such that the first connector 704 cannot be removed from the first connector receptacle without the first coupling portion 711 on the first securing member 710 being removed from the first aperture 308*a* to disengage the first securing surface 711*a* from the first connector coupling member 308.

The connector release actuator 714 is configured to overcome the biasing member 726 to move the at least one securing member 710 from a securing orientation 1010 into a releasing orientation 1012 (indicated by the dashed representation of the first securing member 710) in response to either of a first force provided on the connector release actuator 714 in a first direction (as indicated by an arrow 1002 of FIG. 10A), and/or a second force provided on the connector release actuator 714 in a second direction that is substantially perpendicular to the first direction (as indicated by arrow 1006 of FIG. 10B.) The first force and/or the second force may actuate the connector release actuator 714 and, as such, in some embodiments the actuation of the connector release actuator 714 may occur by either pressing the connector release actuator 714 (as indicated by the arrow 1002) and/or by pushing the connector release actuator 714 (as indicated by the arrow 1006.) Actuating the connector release actuator 714 causes the coupling member 728 included in the biasing member 726 to extend the spring 732 and move the proximal end of the first securing member 710 in the direction of the arrow 1002 (in the example illustrated in FIG. 10A) and/or the direction of the arrow 1006 (in the example illustrated in FIG. 10B.) This movement of the first securing member causes the distal end of the first securing member 710 to rotate, as indicated by arrow 1004, resulting in the first coupling portion 711 on the first securing member 710 being removed from the first aperture 308*a* to cause the disengagement of the first securing surface 711*a* and the first connector coupling member 308 (as indicated by the dashed representation of the first securing member 710.)

Figure 11A:
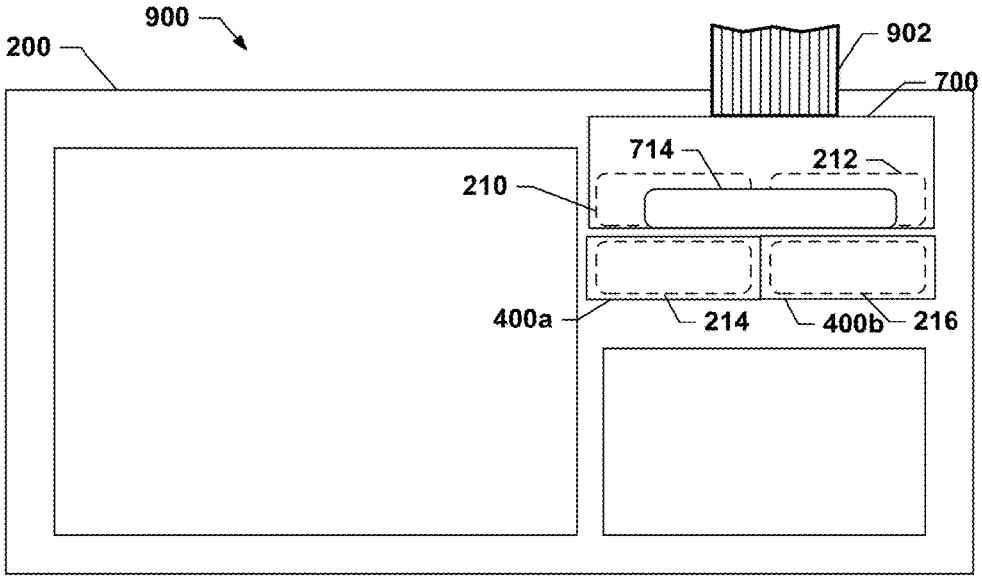
FIG. 11A is a top view illustrating an embodiment of the multiple connector system of FIG. 9A-9C being removed from the board.
Figure 11B:
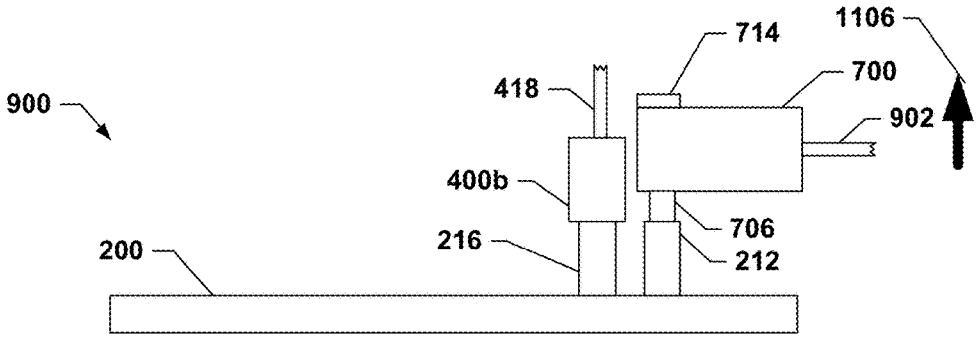
FIG. 11B is a side view illustrating an embodiment of the multiple connector assembly being removed from the board of FIG. 11A.
Figure 11C:
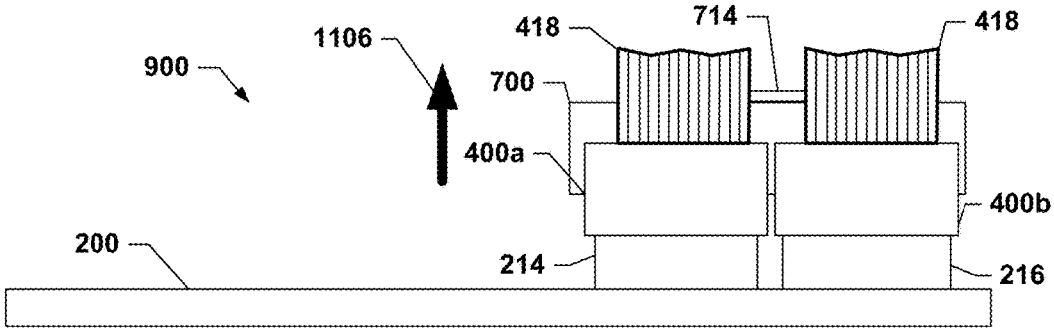
FIG. 11C is a front view illustrating an embodiment of the multiple connector assembly being removed from the board of FIG. 11A.

The method 800 then proceeds to block 806 where the connectors of a multiple connector assembly are removed from connector receptacles. Referring to FIGS. 11A, 11B, and 110, following the actuation of the connector release actuator 714 of the multiple connector assembly 700, the first connector 704 and the second connector 706 may be removed from the connector receptacles 210 and 212, respectively, as indicated by the arrow 1106. FIG. 11B illustrates the second connector 706 partially removed from the second connector receptacle 212. As is also illustrated in the FIGS. 11A-11C, the first cable system 400*a* and the second cable system 400*b* are still connected to the third connector receptacle 214 and the fourth connector receptacle 216 while the multiple connector assembly 700 is being decoupled from the board 200.

Thus, systems and methods have been described that provide for connection and release of a multiple connector assembly. Using the systems and methods of the present disclosure, a user may actuate a connector release actuator located on a top surface of the multiple connector assembly to release its multiple connectors from respective connector receptacles provided in a connector receptacle array on a board, which may be accomplished without having to remove adjacent connectors on other cable systems connected to the connector receptacle array, which is required with conventional dual-in-one plugs utilized in similar applications. Because connectors of additional cable systems do not have to be removed to remove the multiple connector assembly, reconnection errors due to, for example, inserting a removed connector of a cable system in an incorrect connector receptacle, are eliminated. Also, in situations where the multiple connector assembly must be removed when a system is running, possible system downtown due to the need to remove other connectors on the adjacent cable systems can be avoided. The systems and methods of the present disclosure are envisioned as being particularly valuable in NPIO multiple connector assemblies where an array of NPIO connector receptacles are positioned close together on a printed circuit board (PCB) to limit the size of the PCB and/or reduce the space required by the array.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A multiple connector assembly, comprising:
a connector housing;
a first connector that extends from a first surface of the connector housing;
a second connector that extends from the first surface of the connector housing adjacent the first connector;
at least one securing member that is coupled to the connector housing and that is configured to engage at least one connector coupling member to secure the first connector in a first connector receptacle and the second connector in a second connector receptacle; and
a connector release actuator that is located on a second surface of the connector housing that is opposite the first surface of the connector housing, wherein the connector release actuator is configured to actuate the at least one securing member to cause the at least one securing member to disengage with the at least one connector coupling member such that the first connector is no longer secured in the first connector receptacle and the second connector is no longer secured in the second connector receptacle.

2. The multiple connector assembly of claim 1, wherein the at least one securing member is coupled to a biasing member that biases the at least one securing member into a securing orientation.

3. The multiple connector assembly of claim 2, wherein the connector release actuator is configured to overcome the biasing member to move the at least one securing member into a releasing orientation in response to either of a first force provided on the connector release actuator in a first direction, and a second force provided on the connector release actuator in a second direction that is substantially perpendicular to the first direction.

4. The multiple connector assembly of claim 1, further comprising:
a cable that extends from the connector housing and that is coupled to the first connector and the second connector.

5. The multiple connector assembly of claim 1, wherein the first connector and the second connector are Nano-Pitch Input/Output (NPIO) connectors.

6. The multiple connector assembly of claim 1, wherein the at least one securing member includes a first securing member that is located adjacent the first connector, and a second securing member that is located adjacent the second connector.

7. The multiple connector assembly of claim 1, wherein the first connector and the second connector are oriented on the connector housing in an in-line connector orientation that includes a common longitudinal connector axis.

8. An information handing system (IHS), comprising:
a chassis;
a board coupled to the chassis;
at least one board component coupled to the board;
a first connector receptacle coupled to the at least one board component;
a second connector receptacle coupled to the at least one board component, wherein the first connector receptacle and the second connector receptacle include at least one connector coupling member; and
a multiple connector assembly, wherein the multiple connector assembly comprises:

a connector housing;

a first connector that extends from a first surface of the connector housing;

a second connector that extends from the first surface of the connector housing and adjacent the first connector;

at least one securing member that is coupled to the connector housing and that is configured to engage the at least one connector coupling member to secure the first connector in the first connector receptacle and the second connector in the second connector receptacle; and a connector release actuator that is located on a second surface of the connector housing that is opposite the first surface of the connector housing, wherein the connector release actuator is configured to actuate the at least one securing member to cause the at least one securing member to disengage with the at least one connector coupling member such that the first connector is no longer secured in the first connector receptacle and the second connector is no longer secured in the second connector receptacle.

9. The IHS of claim 8, wherein the first connector receptacle and the second connector receptacle are oriented on the board in an in-line connector orientation that includes a common longitudinal connector axis.

10. The IHS of claim 9, further comprising:

a third connector receptacle coupled to the at least one board component and that includes a third connector coupling member, wherein the third connector receptacle is parallel with the first connector receptacle and the second connector receptacle.

11. The IHS of claim 10, wherein the third connector receptacle is spaced apart from the first connector receptacle and the second connector receptacle at a width of less than 1 cm.

12. The IHS of claim 10, further comprising:

a first cable; and a third connector that is located on the first cable and that is secured in the third connector receptacle, wherein the third connector when secured in the third connector receptacle blocks access to a third surface of the connector housing of the multiple connector assembly that extends between the first surface and the second surface.

13. The IHS of claim 12, further comprising:

a fourth connector receptacle coupled to the at least one board component and that includes a fourth connector coupling member, wherein the fourth connector receptacle is parallel with the first connector receptacle and the second connector receptacle and in-oriented on the board in an in-line connector receptacle orientation that includes a common longitudinal connector axis with the third connector receptacle;

a second cable; and a fourth connector that is located on the second cable and that is secured in the fourth connector receptacle, wherein the fourth connector when secured in the fourth connector receptacle blocks access to the third surface of the connector housing of the multiple connector assembly.

14. The IHS of claim 8, wherein the multiple connector assembly further comprises:

a cable that extends from the connector housing and that is coupled to the first connector and the second connector.

15. The IHS of claim 8, wherein the at least one securing member is coupled to a biasing member that biases the at least one securing member into a securing orientation.

16. The IHS of claim 15, wherein the connector release actuator is configured to overcome the biasing member to move the at least one securing member into a releasing orientation in response to either of a first force provided on the connector release actuator in a first direction, and a second force provided on the connector release actuator in a second direction that is substantially perpendicular to the first direction.

17. A method of securing a multiple connector assembly, comprising:

securing a first connector that extends from a first surface of a connector housing in a first connector receptacle; and securing a second connector that extends from the first surface of the connector housing adjacent the first connector in a second connector receptacle, wherein the securing the first connector in the first connector receptacle and the securing the second connector in the second connector receptacle includes:

engaging at least one securing member that is coupled to the connector housing with at least one connector coupling member to secure the first connector in the first connector receptacle and the second connector in the second connector receptacle, wherein the first connector is no longer secured with the first connector receptacle and the second connector is no longer secured with the second connector receptacle when a connector release actuator that is located on a second surface of the connector housing that is opposite the first surface of the connector housing actuates the at least one securing member to cause the at least one securing member to disengage with the at least one connector coupling member.

18. The method of claim 17, further comprising:

actuating the connector release actuator; and removing the first connector from the first connector receptacle and removing the second connector from the second connector receptacle when the first connector is no longer secured with the first connector receptacle and the second connector is no longer secured with the second connector receptacle.

19. The method of claim 17, wherein the engaging the at least one securing member that is coupled to the connector housing with at least one connector coupling member to secure the first connector in the first connector receptacle and the second connector in the second connector receptacle includes biasing a biasing member that biases the at least one securing member into a securing orientation.

20. The method of claim 19, further comprising:

moving the biasing member to move the at least one securing member into a releasing orientation in response to at least one of a first force provided on the connector release actuator in a first direction and a second force provided on the connector release actuator in a second direction that is substantially perpendicular to the first direction.

* * * * *